US009346612B2

(12) United States Patent
Plunkett et al.

(10) Patent No.: US 9,346,612 B2
(45) Date of Patent: May 24, 2016

(54) FLEXIBLE LINER FOR FIBC OR BAG-IN-BOX CONTAINER SYSTEMS

(75) Inventors: James Plunkett, Wareham, MA (US); Robert H. P. Fougere, Scituate, MA (US)

(73) Assignee: CDF CORPORATION, Plymouth, MA (US)

( * ) Notice: Subject to any disclaimer, the term of this patent is extended or adjusted under 35 U.S.C. 154(b) by 863 days.

(21) Appl. No.: 12/883,040

(22) Filed: Sep. 15, 2010

(65) Prior Publication Data

US 2011/0000918 A1 Jan. 6, 2011

Related U.S. Application Data

(63) Continuation of application No. 10/900,068, filed on Jul. 27, 2004, now Pat. No. 7,798,711.

(51) Int. Cl.
*B65D 30/20* (2006.01)
*B65D 88/16* (2006.01)
(Continued)

(52) U.S. Cl.
CPC ..... *B65D 88/1668* (2013.01); *B65D 75/5877* (2013.01); *B65D 77/06* (2013.01); *B65D 88/1618* (2013.01); *B65D 2590/046* (2013.01)

(58) Field of Classification Search
CPC ..... B65D 88/1618; Y10S 383/906; Y10S 383/904
USPC ..... 383/120, 104, 66, 107, 121, 907, 903
See application file for complete search history.

(56) References Cited

U.S. PATENT DOCUMENTS 875,780 A 1/1908 Coats
931,808 A 8/1909 Smith
(Continued)

FOREIGN PATENT DOCUMENTS

CA 1 159 379 12/1983
CA 2 156 796 2/1997
(Continued)

OTHER PUBLICATIONS

Advertisement, "Designed with Food in Mind, the Unifold Food Grade Intermediate Bulk Container," LB Systemer a/s Uni-Fold, Nordgarde 1A-4520 Svinninge Denmark, 5 pgs. Date unknown.
(Continued)

*Primary Examiner* — Jes F Pascua
(74) *Attorney, Agent, or Firm* — Dorsey & Whitney LLP

(57) ABSTRACT

The present invention is a collapsible liner for use in a bulk container. The liner comprises a first flexible panel, a second flexible panel, a first seal, a second seal, and a tab. The first flexible panel includes a first longitudinal edge. The second flexible panel includes a second longitudinal edge. The first seal joins the first and second panels near the first and second longitudinal edges and runs generally parallel to the first and second edges. The second seal joins the first and second panels and is generally oblique to the first seal. At least one of the panels extends across at least one of the seals to form the tab, which includes an attachment feature. The attachment feature may be a piece of tape affixed to the tab. The attachment feature may be a strip of fabric or other reinforcement material melted into the tab, sealed within the tab or affixed to the tab via an adhesive. The attachment feature may be a hole with sealed or unsealed edges. The attachment feature may be a grommet or a loop for receiving a hook.

10 Claims, 8 Drawing Sheets

(51) Int. Cl.
*B65D 75/58* (2006.01)
*B65D 77/06* (2006.01)

(56) References Cited

U.S. PATENT DOCUMENTS 1,120,058 A 12/1914 Hutto
1,132,000 A 3/1915 Dight
1,135,866 A 4/1915 Turner
2,083,776 A 6/1937 Ferguson
2,155,057 A 4/1939 Moore
2,260,064 A 10/1941 Stokes
2,333,587 A 11/1943 Salfisberg
2,339,156 A 1/1944 Davis
2,446,308 A 8/1948 Smith
2,533,554 A 12/1950 Byerly
2,638,263 A 5/1953 Jesnig
2,720,998 A 10/1955 Potter
2,738,796 A 3/1956 Chadwick
2,757,669 A 8/1956 Gewecke et al.
2,799,314 A 7/1957 Dreyer et al.
2,930,423 A 3/1960 Cunningham
2,950,037 A 8/1960 Orsini
2,951,628 A 9/1960 Grussen
2,956,839 A 10/1960 Hermanns
2,973,119 A 2/1961 Parker
3,006,257 A 10/1961 Orsini
3,039,656 A 6/1962 Wentz
3,044,515 A 7/1962 Eades
3,087,491 A 4/1963 Gewecke et al.
3,119,548 A 1/1964 Cook et al.
3,143,277 A 8/1964 LaFleur
3,208,658 A 9/1965 Membrino
3,224,640 A 12/1965 Schneider
3,244,576 A 4/1966 Swartz
3,253,764 A 5/1966 Goetschius
3,275,197 A 9/1966 Eklund
3,289,386 A 12/1966 Farmer
3,319,684 A 5/1967 Calhoun
3,326,449 A * 6/1967 Dickson ..... 383/94
3,349,991 A 10/1967 Kessler
3,367,380 A 2/1968 Dickey
3,370,774 A 2/1968 Hopf
3,384,106 A 5/1968 Isbrandtsen
3,386,645 A 6/1968 Powell
3,415,440 A 12/1968 Watters
3,434,652 A 3/1969 Shore
3,447,732 A 6/1969 Jonas
3,462,067 A 8/1969 Shore
3,510,142 A 5/1970 Erke
3,550,662 A 12/1970 Remke et al.
3,559,847 A 2/1971 Goodrich
3,709,426 A 1/1973 Farkas
3,739,977 A 6/1973 Shapiro et al.
3,761,013 A 9/1973 Schuster
3,836,217 A 9/1974 Shiina
3,853,238 A 12/1974 Luisada et al.
3,868,891 A 3/1975 Parish
3,951,284 A 4/1976 Fell et al.
3,965,953 A 6/1976 Becker et al.
3,989,157 A 11/1976 Veenema
3,995,806 A 12/1976 McSherry
4,011,798 A 3/1977 Bambara et al.
4,025,048 A 5/1977 Tibbitts
4,085,244 A 4/1978 Stillman
4,169,548 A 10/1979 Bond
4,174,051 A 11/1979 Edwards
4,177,907 A 12/1979 Funaioli et al.
4,184,527 A 1/1980 Kawamura
4,239,111 A 12/1980 Conant et al.
4,267,960 A 5/1981 Lind et al.
4,270,533 A 6/1981 Andreas
4,309,466 A 1/1982 Stillman
4,362,199 A 12/1982 Futerman
4,421,253 A 12/1983 Croley
4,449,646 A 5/1984 Bonerb et al.
4,457,456 A 7/1984 Derby et al.
4,461,402 A 7/1984 Fell et al.
4,476,998 A 10/1984 Bonerb et al.
4,482,074 A 11/1984 Lalley
4,524,459 A 6/1985 Titchenal
4,548,321 A 10/1985 Mokesch et al.
4,560,090 A 12/1985 Okushita
4,561,107 A 12/1985 Herder
4,596,040 A 6/1986 LaFleur et al.
4,597,102 A 6/1986 Nattrass
RE32,232 E 8/1986 Bonerb et al.
4,636,190 A 1/1987 Herder
4,673,112 A 6/1987 Bonerb
4,674,127 A 6/1987 Yamada et al.
4,676,373 A 6/1987 Schneider
4,715,508 A 12/1987 Schurch
4,718,577 A 1/1988 Morris et al.
4,730,942 A 3/1988 Fulcher
4,781,472 A 11/1988 LaFleur et al.
4,783,178 A 11/1988 Herder
4,790,029 A 12/1988 LaFleur et al.
4,796,788 A 1/1989 Bond
4,804,113 A 2/1989 Ciaccio
4,850,506 A 7/1989 Heaps et al.
4,874,258 A 10/1989 Marino
4,898,301 A 2/1990 Schick
4,917,255 A 4/1990 Foy
4,931,034 A 6/1990 Wagner
4,941,754 A 7/1990 Murdock
4,997,108 A 3/1991 Hata
4,998,990 A 3/1991 Richter et al.
5,002,194 A 3/1991 Nichols
5,020,922 A 6/1991 Schirmer
5,029,734 A 7/1991 Nichols
5,037,002 A 8/1991 Tschanen
5,040,693 A 8/1991 Podd et al.
5,054,644 A 10/1991 Greenslade
5,056,667 A 10/1991 Coogan
5,074,460 A 12/1991 Hanekamp
5,096,092 A 3/1992 Devine
5,104,236 A 4/1992 LaFleur
5,120,586 A 6/1992 Nedzu et al.
5,127,893 A 7/1992 LaFleur
5,156,291 A 10/1992 Mielke
5,193,710 A 3/1993 Podd et al.
5,195,661 A 3/1993 Light
5,253,763 A 10/1993 Kirkley et al.
5,269,414 A 12/1993 D'Hollander
5,302,402 A 4/1994 Dudenhoeffer et al.
5,314,086 A 5/1994 Short
5,314,250 A 5/1994 Lee
5,330,069 A 7/1994 Jamison et al.
5,335,820 A 8/1994 Christianson
5,338,117 A 8/1994 Kucksdorf et al.
5,344,048 A 9/1994 Bonerb
5,344,065 A 9/1994 Moran
5,350,239 A 9/1994 Strand et al.
5,368,395 A 11/1994 Crimmins
5,400,916 A 3/1995 Weber
5,427,306 A 6/1995 Petriekis et al.
5,487,470 A 1/1996 Pharo
5,489,037 A 2/1996 Stopper
5,492,270 A 2/1996 Avery et al.
5,494,394 A 2/1996 Podd et al.
5,499,743 A 3/1996 Blumenkron
5,531,361 A 7/1996 Podd
5,547,284 A 8/1996 Imer
5,549,944 A 8/1996 Abate
5,588,549 A 12/1996 Furtner
5,618,254 A 4/1997 Derby
5,636,764 A 6/1997 Bonerb
5,660,299 A 8/1997 Harvey
5,692,546 A 12/1997 Podd et al.
5,711,444 A 1/1998 Meacham et al.
5,765,723 A 6/1998 Wilcox
5,775,541 A 7/1998 Perkins
5,788,121 A 8/1998 Sasaki et al.
5,799,818 A 9/1998 Ringer
5,851,072 A 12/1998 LaFleur

(56) References Cited

U.S. PATENT DOCUMENTS

| | | | | |
|---|---|---|---|---|
| 5,865,541 | A | 2/1999 | LaFleur | |
| 5,915,596 | A | 6/1999 | Credle, Jr. | |
| 5,918,984 | A | 7/1999 | Lafleur et al. | |
| 5,941,421 | A | 8/1999 | Overman et al. | |
| 5,984,850 | A | 11/1999 | Derby | |
| 5,988,422 | A | 11/1999 | Vallot | |
| 6,120,181 | A | 9/2000 | Wilcox | |
| 6,139,482 | A | 10/2000 | LaFleur | |
| 6,193,416 | B1 | 2/2001 | Kawamata et al. | |
| 6,234,351 | B1 | 5/2001 | Wilcox | |
| 6,332,711 | B1 | 12/2001 | Inuzuka et al. | |
| 6,371,646 | B1 | 4/2002 | LaFleur | |
| 6,374,579 | B1 | 4/2002 | Muller | |
| 6,378,733 | B1 | 4/2002 | Boonzaier | |
| 6,427,873 | B2 | 8/2002 | Wilcox | |
| 6,443,617 | B2 | 9/2002 | Tetenborg | |
| 6,467,652 | B2 | 10/2002 | Wilcox et al. | |
| 6,527,445 | B2 | 3/2003 | LaFleur et al. | |
| 6,533,122 | B1 | 3/2003 | Plunkett | |
| 6,536,687 | B1 | 3/2003 | Navis et al. | |
| 6,588,681 | B2 | 7/2003 | Rothrum et al. | |
| 6,595,441 | B2 | 7/2003 | Petrie et al. | |
| 6,607,097 | B2 | 8/2003 | Savage et al. | |
| 6,644,510 | B2 | 11/2003 | Kowalics et al. | |
| 6,663,018 | B2 | 12/2003 | Rothrum et al. | |
| 6,752,179 | B1 | 6/2004 | Schwartz | |
| 6,883,683 | B1 | 4/2005 | Cunningham et al. | |
| 7,077,309 | B2 | 7/2006 | Andrews | |
| 7,244,064 | B2 | 7/2007 | Sullivan, Jr. | |
| 7,334,702 | B2 | 2/2008 | Cunningham et al. | |
| 7,798,711 | B2 * | 9/2010 | Plunkett et al. | 383/22 |
| 2002/0071922 | A1 | 6/2002 | Bailey | |
| 2002/0148857 | A1 | 10/2002 | Savage et al. | |
| 2002/0164089 | A1 | 11/2002 | LaFleur et al. | |
| 2003/0235349 | A1 | 12/2003 | Richardson, Jr. et al. | |
| 2005/0017011 | A1 | 1/2005 | Andrews | |
| 2005/0078890 | A1 | 4/2005 | Abe et al. | |
| 2005/0100252 | A1 | 5/2005 | Rivlin et al. | |
| 2005/0220369 | A1 | 10/2005 | Sullivan, Jr. | |
| 2005/0220639 | A1 | 10/2005 | Sasaki et al. | |
| 2006/0023973 | A1 | 2/2006 | Plunkett et al. | |
| 2007/0076988 | A1 | 4/2007 | Sullivan et al. | |
| 2007/0201774 | A1 | 8/2007 | Plunkett et al. | |

FOREIGN PATENT DOCUMENTS

| | | | | |
|---|---|---|---|---|
| DE | 60 598 | | 11/1890 | |
| DE | 1 486 433 | | 4/1969 | |
| DE | G 89 06 059.8 | | 11/1989 | |
| EP | 0 098 322 | | 1/1984 | |
| EP | 0 362 102 | | 4/1990 | |
| EP | 0 276 994 | | 12/1992 | |
| EP | 1 277 666 | | 1/2003 | |
| EP | 1 435 265 | | 7/2004 | |
| EP | 1 415 719 | | 5/2009 | |
| FR | 1 331 060 | | 5/1963 | |
| FR | 2 316 151 | | 3/1977 | |
| FR | 2 375 113 | | 8/1978 | |
| FR | 2 742 129 | | 6/1997 | |
| GB | 794125 | | 4/1958 | |
| GB | 1 591 323 | | 6/1981 | |
| GB | 2 194 512 | | 3/1988 | |
| GB | 2 245 883 | | 1/1992 | |
| GB | 2 268 231 | | 1/1994 | |
| GB | 2 323 846 | | 10/1998 | |
| GB | 2 356 854 | | 6/2001 | |
| JP | 64-009174 | | 1/1989 | |
| JP | 2-139383 | | 5/1990 | |
| JP | 5-221451 | | 8/1993 | |
| JP | 6-115557 | | 4/1994 | |
| JP | 6-122457 | | 5/1994 | |
| JP | 6-179455 | | 6/1994 | |
| JP | 6-255657 | | 9/1994 | |
| JP | 8-104391 | | 4/1996 | |
| JP | 2005104572 | A * | 4/2005 | B65D 30/20 |
| WO | WO 82/03838 | | 11/1982 | |
| WO | WO 89/11422 | | 11/1989 | |
| WO | WO 98/32539 | | 7/1998 | |
| WO | WO 02/057151 | | 7/2002 | |
| WO | WO 02/064456 | | 8/2002 | |
| WO | WO 02/074226 | | 9/2002 | |
| WO | WO 2007/038438 | | 4/2007 | |

OTHER PUBLICATIONS

Advertisement, "Stocklin, Collapsible Container, innovative and Environment-Friendly Packaging," Walter Stocklin AG, Forder Und Lagertechnik, CH-4143 Dornach/Schweiz, 4 pgs. Date unknown.

Advertisement, "CFS Developments (Proprietary) Ltd.," Postal Address: P.O. Box 4852 Luipaardsvlei 1743 South Africa, 4 pgs. Date unknown.

Advertisement, "Reusable Container Systems, Industry Leader in quality, innovation and service," Ropak Corporation, Materials Handling Group, A Member of the Linpac Group of Companies, 7 pgs. Date unknown.

Advertisement, "ECONOBOX, A Whole New Dimension, Cost-effective Solutions for Materials Handling," GE Polymer Logistics, 3 pgs. Date unknown.

Advertisement, "Introducing the Arena 330 Shipper, It beats the drum and everything else," GE Silicones, A. R. Arena Products, Inc., 2101 Mt. Read Blvd., Rochester, New York, 1465, 4 pgs. Date unknown.

Advertisement, TNT Container Logistics, Containers for Hazardous Goods, Hazcon & Uni-Fold, 2 pgs. Date unknown.

Author unknown, "TNT: TNT Liquid Discharge Roller Arm," 2 pgs., date unknown.

* cited by examiner

FLEXIBLE LINER FOR FIBC OR BAG-IN-BOX CONTAINER SYSTEMS

CROSS-REFERENCE TO RELATED APPLICATIONS

This application is a continuation of U.S. application Ser. No. 10/900,068, filed Jul. 27, 2004, issued as U.S. Pat. No. 7,798,711 on Sep. 21, 2010, which is incorporated herein by reference in its entirety.

FIELD OF THE INVENTION

The present invention relates to flexible liners for use in bulk containers such as those used in flexible intermediate bulk container ("FIBC") systems or bag-in-box container systems. More particularly, the present invention relates to systems and methods for securing a flexible liner within a container used in a FIBC or bag-in-box container system. The present invention also relates to systems and methods of draining flexible liners used in FIBC or bag-in-box container systems.

BACKGROUND OF THE INVENTION

In recent years a number of industries have adopted the FIBC or bag-in-box concept for storing and transporting liquid and particulate commodities in relatively large quantities. For example, the FIBC or bag-in-box concept has been employed for transporting in bulk such diverse products as vegetable oils, salad dressings, syrups, soy sauce, peanut butter, pharmaceuticals, talc, motor oil, industrial chemicals, detergents in liquid or powder form, and toiletry products or ingredients.

The FIBC concept is a bulk container system comprising a flexible liner in a flexible or semi-flexible bag. In one embodiment, a NBC bag is made of a woven material (e.g., woven polymer, TYVEX®, canvas, wire mesh or net). The flexible liner is typically chemically resistant and impermeable to water and air and serves as the container for a selected commodity. The FIBC bag serves as a protective container for the liner and its contents. A FIBC bag is disclosed in U.S. Pat. No. 4,596,040 to LaFleur et al., which issued Jun. 17, 1986 and is hereby incorporated by reference in its entirety.

The bag-in-box concept comprises a flexible liner and a rigid or semi-rigid box. The flexible liner is typically chemically resistant and impermeable to water and air and serves as the container for a selected commodity. The box may be made of plywood or other wood materials, cardboard, fiberboard, metal or plastic. The box serves as a protective container for the liner and its contents. A box for a bag-in-box system is disclosed in U.S. Pat. No. 6,533,122 to Plunkett, which issued Mar. 18, 2003 and is hereby incorporated by reference in its entirety. A bag for use in a bag-in-box system is disclosed in U.S. patent application Ser. No. 10/818,882, which was filed Apr. 6, 2004, is entitled "Bag With Flap For Bag-In-Box Container System" and is hereby incorporated by reference in its entirety.

By way of example, a liner used for shipping commodities in bulk, via a FIBC or bag-in-box system, typically may have a volume in the order of 60 cubic feet. In one embodiment, the liner will include at least a drain fitting near the bottom of the liner whereby the liner's contents may be removed. In other embodiments, the liner will include at least a filler fitting near the top of the liner whereby the liner may be filled with its contents. In other embodiments, the liner will include both a filler fitting near the top of the liner and a drain fitting near the bottom of the liner.

In embodiments of the liner with at least a drain fitting, the outer container (i.e., the bag of a FIBC system or the box of a bag-in-box system) is provided with a discharge opening near or at the bottom end of the outer container through which the liquid or particulate contents can be discharged from the liner via its drain fitting. The discharge opening of the outer container may be fitted with a drain fitting that mates with or accommodates the drain fitting of the liner. This mating arrangement between drain fittings of the liner and outer container assures that material discharged from the liner will be directed to the intended receiving facility and prevents the material from accumulating in the bottom of the outer container.

In embodiments of the liner with at least a filler fitting, the outer container usually comprises a cover or top panel that is removable to permit access to the liner and the filler fitting.

An important financial consideration of the FIBC or bag-in-box mode of shipment of materials in bulk is that the outer container can be a non-returnable or one-way container. For example, where the outer container is a box for a bag-in-box system and is generally made of a corrugated fiberboard or the like, the box can be discarded after use. Alternatively, the box may consist of interlocking panels of metal, wood or a stiff or rigid plastic material, in which case the box may be disassembled and returned to the shipper after the associated liner has been emptied of its contents.

Where the outer container is a bag for a FIBC system and is made of a low cost woven material, the bag can be discarded after use. Alternatively, where the material of the bag is more expensive, the bag may be collapsed and returned to the shipper after the associated liner has been emptied of its contents.

With respect to the FIBC and bag-in-box concepts as applied to bulk shipment of commodities, the plastic flexible liners have taken various forms. One common form is the so-called "pillow" type, which consists of at least two sheets of plastic film sealed together at their edges. Another common form is the six-sided flexible liners (e.g., liners that take the shape of a cube or rectangular parallelepiped when filled) made from a plurality of sheets of plastic film.

Regardless of the type of liner in the outer container, if the liner is large (e.g., a liner having a volume of about 275 gallons or more), it can be difficult to completely fill or empty the liner. This is especially the case when the content of the liner is a viscous liquid. During the discharge of the liner's contents, the evacuated portion of the liner has a tendency to collapse due to a vacuum affect. Similarly, when the liner is being filled, the liner again tends to collapse because the contents pull the sides of the liner downward. In either case, as the liner collapses, folds are created that entrap the contents of the liner.

During emptying of a large liner, the emptying process can still be difficult and incomplete even if liner collapse is minimal. This is because the liner bottom typically does not slope towards the drain fitting. Consequently, the contents of the liner can tend to pool in the bottom of the liner.

There is a need in the art for a system and method of supporting a liner off of an outer container used in a FIBC or bag-in-box system, thereby decreasing the tendency of the liner to collapse during filling or emptying of the liner. There is also a need in the art for a system and method of causing a liner bottom to slope towards the drain fitting of the liner.

BRIEF SUMMARY OF THE INVENTION

The present invention, in one embodiment, is a collapsible liner for use in a bulk container. The liner comprises a first flexible panel, a second flexible panel, a first seal, a second seal, and a tab. The first flexible panel includes a first longitudinal edge. The second flexible panel includes a second longitudinal edge. The first seal joins the first and second panels near the first and second longitudinal edges and runs generally parallel to the first and second edges. The second seal joins the first and second panels and is generally oblique to the first seal. At least one of the panels extends across at least one of the seals to form the tab, which includes an attachment feature adapted to facilitate the attachment of the tab to the bulk container.

The present invention, in another embodiment, is a collapsible liner for use in a bulk container. The liner comprises first, second and third flexible panels, first, second, third, fourth and fifth seals, and a tab. The first flexible panel includes a first longitudinal edge and a first lateral edge generally perpendicular to the first longitudinal edge. The second flexible panel includes a second longitudinal edge and a second lateral edge generally perpendicular to the second longitudinal edge. The third flexible panel includes a third longitudinal edge, a fourth longitudinal edge generally parallel to the third longitudinal edge, and a third lateral edge generally perpendicular to the third longitudinal edge.

The first seal joins the first and third panels near the first and third longitudinal edges and runs generally parallel to the first and third edges. The second seal joins the second and third panels near the second and fourth longitudinal edges and runs generally parallel to the second and fourth edges. The third seal joins the first and third panels and is generally oblique to the first seal. The fourth seal joins the second and third panels and is generally oblique to the second seal. The fifth seal joins the first and second panels near the first and second lateral edges and runs generally perpendicular to the first and second longitudinal edges.

The first panel extends across the third seal to the fifth seal. The second panel extends across the fourth seal to the fifth seal. The tab is defined in the first panel between the third and fifth seals. The tab includes an attachment feature adapted to facilitate the attachment of the tab to the bulk container.

The present invention, in another embodiment, is a liner for use in a bulk container. The liner comprises a first flexible panel and a tab. The tab is defined in a portion of the first panel and includes a piece of tape affixed to the tab.

The present invention, in another embodiment, is a liner for use in a bulk container. The liner comprises a first flexible panel and a tab defined in a portion of said first panel. The tab includes a piece of fabric or other reinforcement material. In one embodiment, the fabric or other material is affixed to the tab via an adhesive. In other embodiments, the fabric or other material is melted into the tab or sealed within a tab.

The present invention, in another embodiment, is a liner for use in a bulk container. The liner comprises a first flexible panel joined to a second flexible panel by a first seal and a second seal oblique to the first seal. The first and second seals form an intersection. At least one of the panels extends across at least one of the seals to form an elongated tab adapted for connection to the bulk container. In one embodiment, the elongated tab is sufficiently long to facilitate its attachment and use with a winder. In one embodiment, the elongated tab is configured such that its length, from a free distal end of the tab to the intersection, is approximately two times or greater the width of the tab. In one embodiment, the elongated tab is configured such that its length is approximately three times or greater the width of the tab. In one embodiment, the elongated tab is configured such that its length is approximately four times or greater the width of the tab.

The present invention, in another embodiment, is a method of attaching a liner to a bulk container where the liner comprises a first flexible panel and an elongated tab defined in a portion of said first panel. In one embodiment the tab further comprises an attachment feature adapted to facilitate the attachment of the tab to the bulk container. The method comprises extending the tab from the liner to a surface of the bulk container and affixing the tab to the surface of the bulk container. In one embodiment, attachment feature is a strip of tape and the tab is affixed to the surface of the bulk container via an adhesive on the tape. In another embodiment, whether the attachment feature is a strip of tape or a piece of fabric or reinforcement material, the tab is affixed to the surface of the bulk container by stitching through the tape or fabric, the tab and into the surface of the bulk container.

The present invention, in another embodiment, is a liner for use in a bulk container. The liner comprises first, second, third and fourth flexible panels, first and second pairs of oblique seals, a cross seal, and first and second pairs of side seals.

The first flexible panel and the second flexible panel are opposed to each other. Each of the first and second panels includes a pair of side edges. The third flexible panel and the fourth flexible panel are opposed to each other and are located between the first and second panels. Each of the third and fourth panels includes a pair of side edges.

The first pair of oblique seals joins the first panel to the third and fourth panels. Each oblique seal of the first pair of oblique seals runs along the first panel generally oblique to the side edges of the first panel. The oblique seals of the first pair of oblique seals converge towards each other to define a first truncated apex. Each oblique seal of the first pair of oblique seals has a portion near the first apex that transitions through a radius to a segment generally parallel to the side edges of the first panel.

The second pair of oblique seals joins the second panel to the third and fourth panels. Each oblique seal of the second pair of oblique seals runs along the second panel generally oblique to the side edges of the second panel. The oblique seals of the second pair of oblique seals converge towards each other to define a second truncated apex. Each oblique seal of the second pair of oblique seals has a portion near the first apex that transitions through a radius to a segment generally parallel to the side edges of the first panel.

The cross seal joins the first panel to the second panel at the truncated apexes of the first and second panels. More specifically, in one embodiment, the cross seal perpendicularly intersects the segments of the seals of the first and second pairs of oblique seals.

The first pair of side seals runs generally parallel to the side edges of the first panel and joins the third and fourth panels to the first panel. In one embodiment, each side seal of the first pair of side seals intersects an end of an oblique seal of the first pair of oblique seals opposite the first apex.

The second pair of side seals runs generally parallel to the side edges of the second panel and joins the third and fourth panels to the second panel. In one embodiment, each side seal of the second pair of side seals intersects an end of an oblique seal of the second pair of oblique seals opposite the second apex.

In one embodiment, the first and second apexes converge to form an end wall of the liner. In one embodiment, the first and second pairs of oblique seals define apexes in the third and fourth panels that are generally non-truncated, or in other words, generally pointed. These apexes in the third and forth panels also join with the apexes in the first and second panels to form an end wall of the liner.

The present invention, in another embodiment, is a liner for use in a bulk container. The liner comprises a first flexible side panel, a second flexible side panel, a seal, a top flap and a tab. The second flexible side panel forms a side edge of the container. The seal joins the first flexible side panel to the second flexible side panel and runs generally oblique to the side edge. The top flap is defined in at least one of the flexible side panels between the seal and a top edge of the at least one flexible side panel. The tab defined in the top flap.

In one embodiment, the tab comprises substantially all of the top flap. In one embodiment, the tab is a rectangular portion of the top flap. In one embodiment, the tab is a triangular portion of the top flap.

In one embodiment, the liner further comprises a L-shaped generally continuous cut or series of perforations in the top flap that define a generally rectangular tab. In another embodiment, the liner further comprises a generally continuous cut or series of perforations in the top flap that run generally parallel to at least a portion of the seal and define a tab that is generally triangular and comprises substantially all of the top flap.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION

The present invention is directed to a flexible liner 1 for use in bulk containers such as those used in flexible intermediate bulk container ("FIBC") systems or bag-in-box container systems. Generally speaking, in one embodiment, the flexible liner 1 of the present invention has integrally formed tabs 2 that are partially separable from the liner 1 for connection to an outer container (i.e., the bag of a FIBC system or the box of a bag-in-box system) and/or use in a winder system that can be used to facilitate the emptying of the liner 1.

Figure 1:
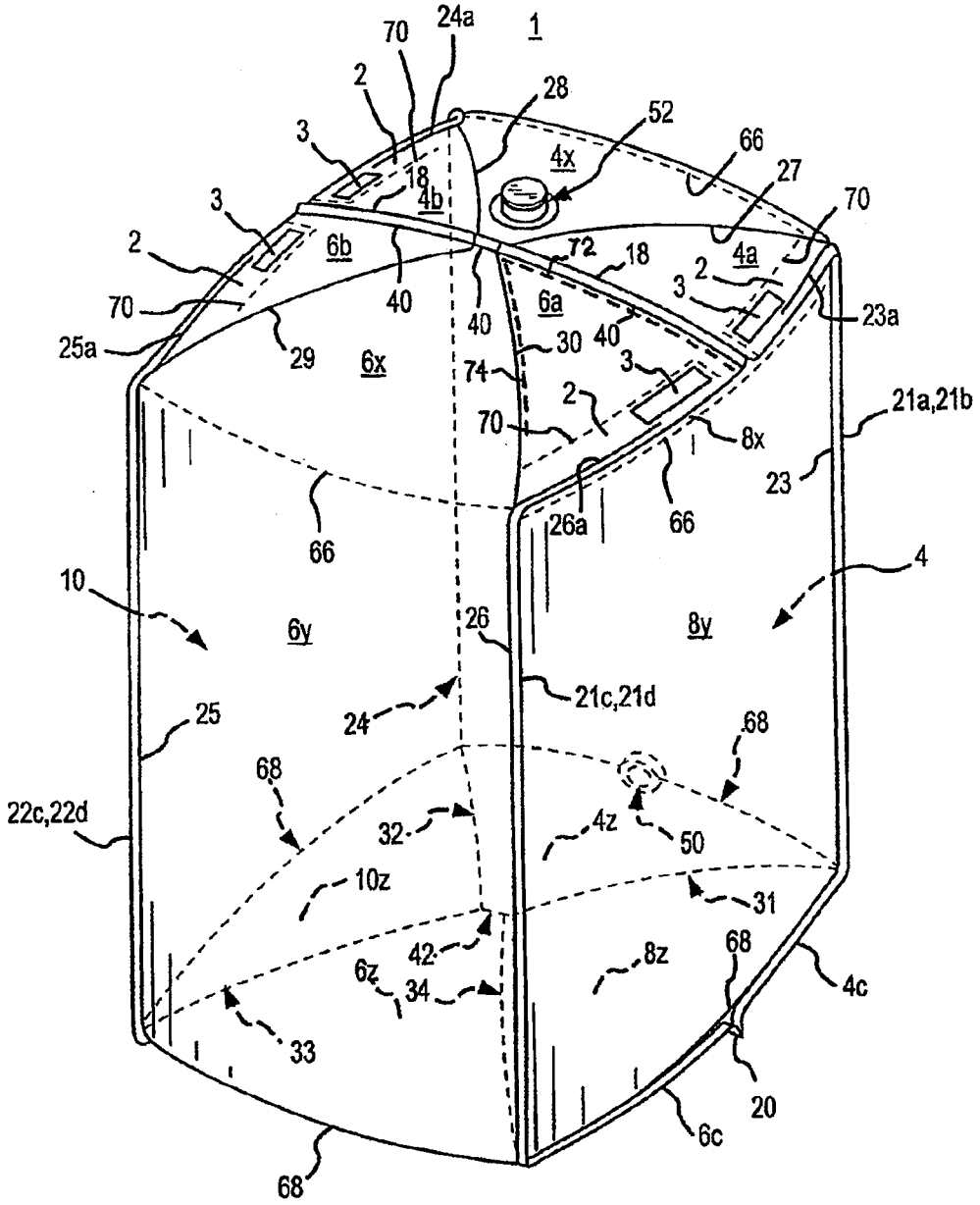
FIG. 1 is a top isometric view of a liner in its inflated or filled state.

FIG. 1 is a top isometric view of the liner 1 in its inflated or filled state. As illustrated in FIG. 1, in one embodiment, the tabs 2 are located near the top portion of the liner 1 and are provided with an attachment feature 3 for securing the tabs 2 to the outer container. Depending on the embodiment, the attachment feature 3 may be a strip of tape, a strip of fabric or another reinforcing material, or a hole through the tab 2. In one embodiment, the tab 2 is not provided with a special attachment feature, but is simply the tab 2.

Once the tabs 2 are affixed to the outer container (whether an attachment feature is employed or not), the tabs 2 support the liner 1 off of the outer container, thereby reducing the degree to which the liner 1 collapses when being filled or emptied. Additionally, when the liner 1 is being emptied, the tabs 2 may be detached from the outer container and connected to a winder system. The tabs 2 are then wound about the winder, which causes the contents of the liner 1 to flow towards the drain fitting 50 of the liner 1.

As indicated in FIG. 1, in one embodiment, the liner 1 is a four side-seal type liner 1 (i.e., a liner having four longitudinal side-seals 23, 24, 25, 26) composed of four discrete portions (i.e., a front portion 4, a rear portion 6 and two side portions 8, 10) of flexible, heat-sealable packaging material in sheet form. By way of example but not limitation, the packaging sheet material may consist of polyethylene or polypropylene or some other thermoplastic material or be a laminate of two or more packaging materials bonded to one another. Each of the portions 4-10 may comprise a single sheet of packaging material ("single ply") or two or more sheets of packaging material ("multi-ply"). In the case of multi-ply portions, the individual sheets ("plies") may be of like or different material and are secured to one another only in selected areas (e.g., at seals 23, 24, 25, 26 and other such seals as discussed in this detailed description). The preferred embodiment is a two-ply liner.

Figure 4:
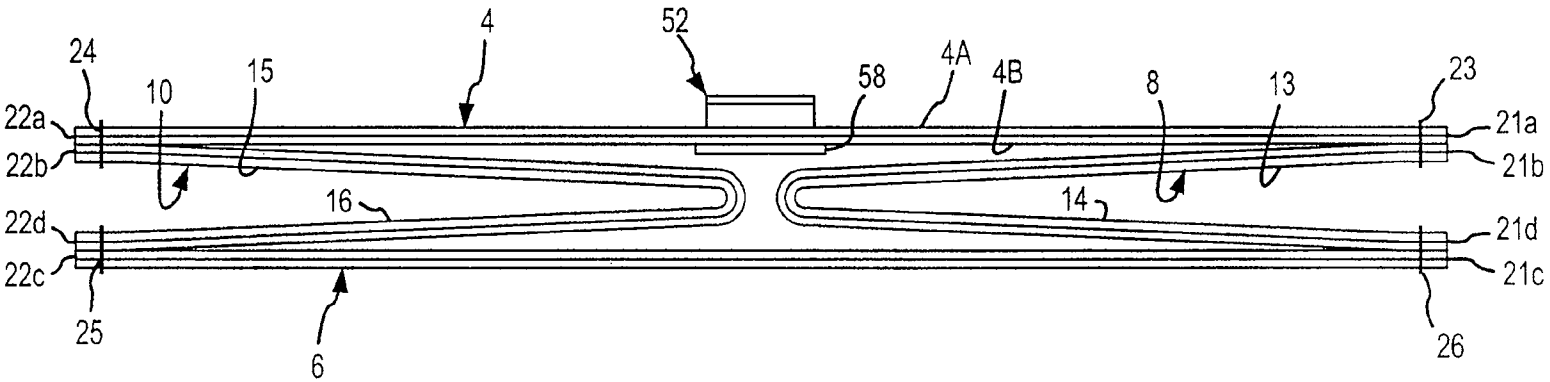
FIG. 4 is a cross sectional view taken along line 4-4 of FIG. 2.
Figure 6:
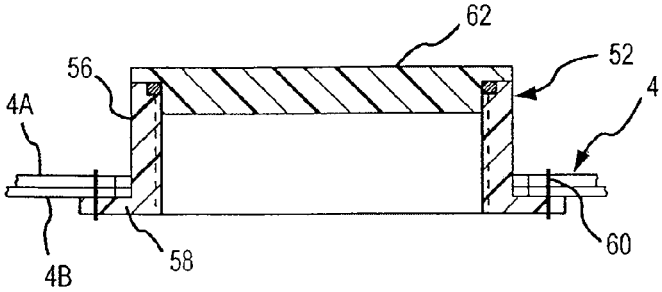
FIG. 6 is a cross sectional view of fill fitment taken along line 6-6 of FIG. 2.

For convenience and simplicity of illustration, the two-ply construction is evidenced only in FIGS. 4 and 6, with the two plies of the front portion 4, for example, being identified as 4A and 4B. However, in the following description, it is to be assumed and understood that each of the four discrete portions 4-10 of the liner 1 consists of two plies of flexible packaging material.

Figure 2:
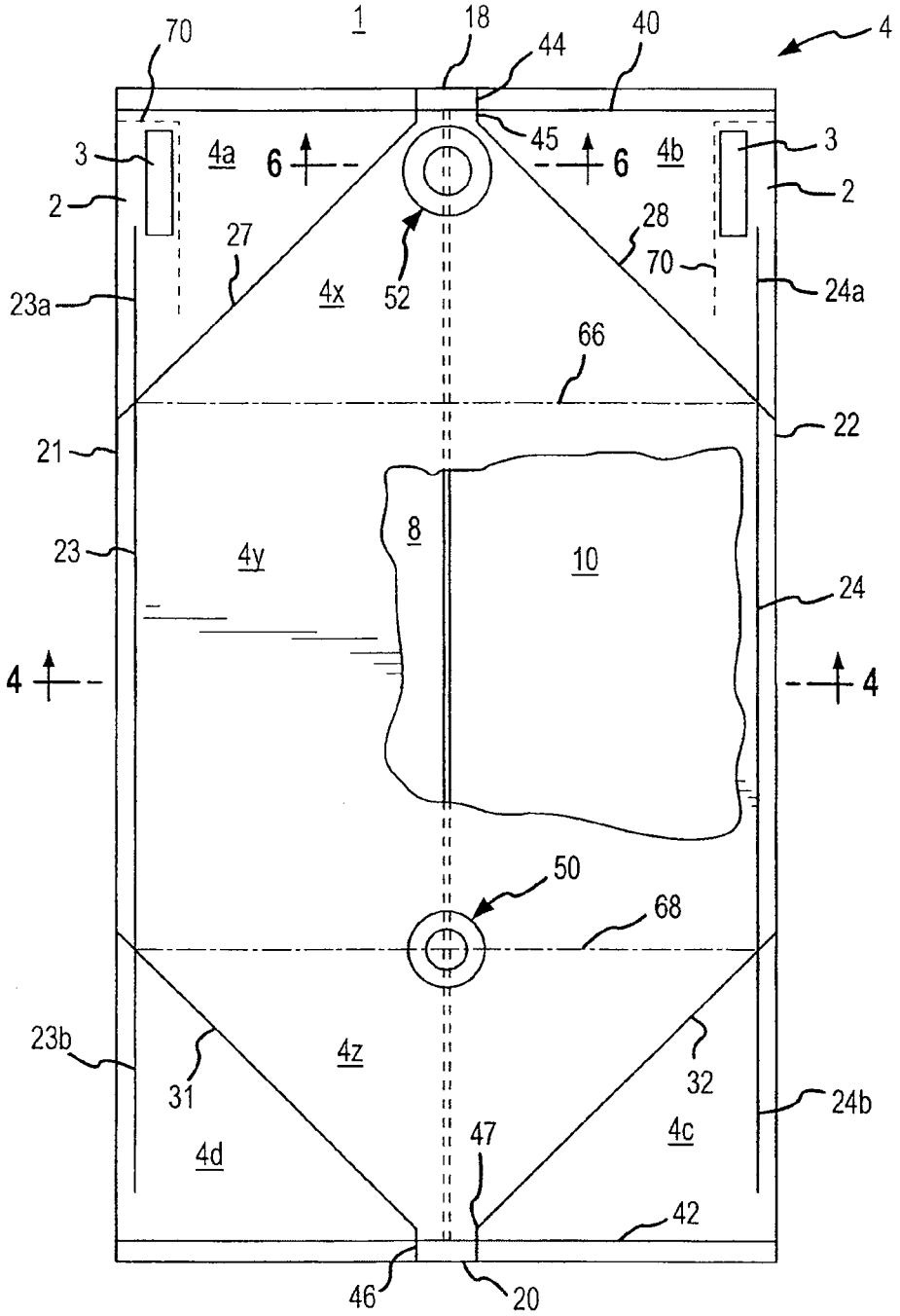
FIG. 2 is a plan view of the liner in a flattened as-made condition, with a part of the liner broken away.
Figure 3:
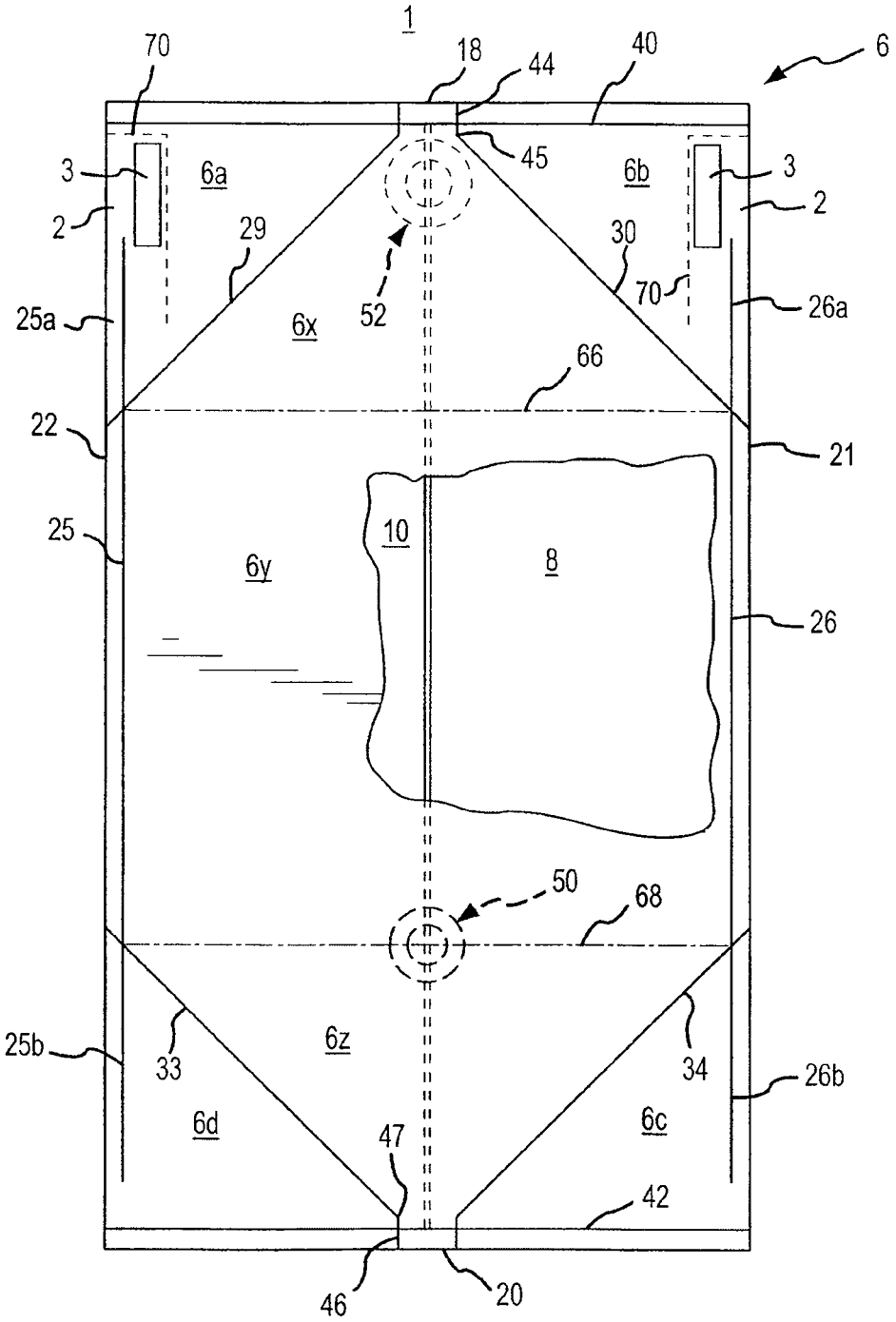
FIG. 3 is a bottom view of the same liner in its flattened as-made condition, with a part of the liner broken away.

For a discussion of the liner 1 in its flat as-formed condition, reference is now made to FIGS. 2-4. FIG. 2 is a plan view of the liner 1 in its flattened as-made condition, with part of the front portion 4 broken away to reveal the side portions 8, 10 below. FIG. 3 is a bottom view of the liner 1 in its flattened as-made condition, with part of the rear portion 6 broken away to reveal the side portions 8, 10 above. FIG. 4 is a cross sectional view of the liner 1 taken along line 4-4 of FIG. 2. As shown in FIGS. 2-4, the front portion 4 and the rear portion 6 are opposed to one another, and the side portions 8, 10 are interposed between the front portion 4 and the rear portion 6. As best illustrated in FIG. 4, the side portions 8, 10 are folded inwardly on themselves to form gussets consisting of folds 13, 14 and 15, 16, respectively.

As indicated in FIGS. 2 and 3, when the liner 1 is in the flattened as-made condition, the front portion 4 and the rear portion 6 have a generally rectangular configuration defined by a top edge 18, a bottom edge 20, and two side edges 21, 22.

During manufacture, the four portions 4-10 are cut from parallel elongate supply webs of packaging material. The four portions 4-10 are substantially the same width (i.e., the distance between the side edges 21*a*, 22*a* with respect to portion 4, the distance between the side edges 21*c*, 22*c* with respect to portion 6, the distance between the side edges 21*b*, 21*d* with respect to portion 8, and the distance between the side edges 22*b*, 22*d* with respect to portion 10) as the webs from which they are separated. The side portions 8, 10 are folded and inserted between the front portion 4 and the rear portion 6 before the four portions 4-10 are cut from the supply webs. As used herein and where the context so admits, the term "web" is to be understood as consisting of a single continuous sheet or two or more sheets that are brought together to form a multi-ply portion of a liner. Alternatively, as used herein, the term "web" is to be understood as consisting of a tubular film that is equivalent to two sheets that are brought together to form a multiply portion of a liner.

As shown in FIGS. 2 and 4, the front portion 4 is sealed via longitudinal seal lines 23, 24 along its two longitudinally extending side edges 21*a*, 22*a* to the adjacent side edges 21*b*, 22*b* of the folds 13, 15 of the respective side portions 8, 10. As indicated in FIGS. 3 and 4, the rear portion 6 is sealed via longitudinal seal lines 25, 26 along its two longitudinally extending side edges 21*c*, 22*c* to the adjacent side edges 21*d*, 22*d* of the folds 14, 16 of the respective side portions 8, 10.

As illustrated in FIGS. 2 and 3, adjacent the top end of the liner 1, two oblique seals 27, 28 secure the front portion 4 to the folds 13, 15, and another two oblique seals 29, 30 secure the rear portion 6 to the folds 14, 16. Adjacent the bottom end of the liner 1, two oblique seals 31, 32 secure the front portion 4 to the folds 13, 15, and another two oblique seals 33, 34 secure the rear portion 6 to the folds 14, 16.

As shown in FIGS. 2 and 3, in one embodiment, the oblique seals 27, 28, 31, 32 extend through the longitudinal seals 23, 24, while the other oblique seals 29, 30, 33, 34 extend through the other longitudinal seals 25, 26. In other embodiments, the oblique seals 27-34 stop at their respective intersections with the longitudinal seals 23-26.

In one embodiment, at the top end of the liner 1, a cross seal 40 extends laterally across the front and rear portions 4, 6 adjacent and parallel to the top edge 18. The top cross seal 40 seals the front and rear portions 4, 6 together along the length of the top cross seal 40. The top oblique seals 27-30 extend from their intersections with their respective longitudinal seals 23-26 towards the top cross seal 40. Just prior to intersecting the top cross seal 40, each top oblique seal 27-30 curves from an oblique orientation to an orientation that is generally parallel to the longitudinal seals 23-26, thereby forming a short segment 44 with a curve 45 for each oblique seal 27-30 that extends through the top cross seal 40.

As shown in FIGS. 2 and 3, at the bottom end of the liner 1, a cross seal 42 extends laterally across the front and rear portions 4, 6 adjacent and parallel to the bottom edge 20. The bottom cross seal 42 seals the front and rear portions 4, 6 together along the length of the bottom cross seal 42. The bottom oblique seals 31-34 extend from their intersections with their respective longitudinal seals 23-26 towards the bottom cross seal 42. Just prior to intersecting the bottom cross seal 42, each bottom oblique seal 31-34 curves from an oblique orientation to an orientation that is generally parallel to the longitudinal seals 23-26, thereby forming a short segment 46 with a curve 47 for each oblique seal 31-34 that extends through the bottom cross seal 42.

In manufacturing the liner 1, the cross seals 40, 42 may require a greater temperature/pressure as compared to those used to make the longitudinal side seals 23-26 and the oblique seals 27-34. This is because, in one embodiment, the cross seals 40, 42 utilize twice as many layers as the side and oblique seals 23-34. For example, referring to the upper right hand corner of FIG. 2, oblique seal 28 and longitudinal side seal 24 are each formed by sealing front portion 4 and side portion 10 together. In contrast, cross seal 40 is formed by sealing together front portion 4, rear portion 6, and portion 10 folded over on itself (i.e., two layers of portion 10 are sealed together with the front and rear portions 4, 6).

As illustrated in FIGS. 2 and 3, the front and rear portions 4, 6 each have a generally hexagonal configuration (as defined by their respective longitudinal side seals 23-26 and oblique seals 27-34), except for being truncated at the upper most point by the top cross seal 40 and at the bottom most point by the bottom cross seal 42. As can be understood from FIG. 1, the side portions 8, 10 also each have a generally hexagonal configuration (as defined by their respective longitudinal side seals 23-26 and oblique seals 27-34) when fully spread out flat. However, as can be understood from FIG. 1, unlike the front and rear portions 4, 6, the upper and lower most points of the side portions 8, 10 are not truncated.

As can be understood from FIG. 1, the curves 45, 47 and the truncated top and bottom end points of the hexagonal front and rear portions 4, 6 form intersections between the panels 4-10 that are advantageous over standard non-truncated intersections found in the prior art. This is because the truncated end points and the curves 45, 47 reduce stress concentrations in the intersection areas as compared to the non-truncated intersections found in the prior art.

In one embodiment, the curves 45, 47 have a radius of between approximately 0.5" to approximately 4.0". In another embodiment, the curves 45, 47 have a radius of between approximately 1.0" to approximately 3.0". In one embodiment, the radius is approximately 2.0".

As can be understood from FIGS. 1-3, the hexagonal configuration of each portion 4-10 can be divided into three parts, which are a top triangular section 4*x*, 6*x*, 8*x*, 10*x*, a rectangular section 4*y*, 6*y*, 8*y*, 10*y*, and a bottom triangular section 4*z*, 6*z*, 8*z*, 10*z*. The top triangular sections 4*x*, 6*x*, 8*x*, 10*x* are defined by the top oblique seals 27-30 and top fold lines 66 that run parallel to the top cross seal 40 and intersect the intersections between the top oblique seals 27-30 and the longitudinal side seals 23-26. Similarly, the bottom triangular sections 4*z*, 6*z*, 8*z*, 10*z* are defined by the bottom oblique seals 31-34 and bottom fold lines 68 that run parallel to the bottom cross seal 42 and intersect the intersections between the bottom oblique seals 31-34 and the longitudinal side seals 23-26. The rectangular sections 4*y*, 6*y*, 8*y*, 10*y* are defined by the longitudinal side seals 23-26 and the top and bottom fold lines 66, 68.

As can be understood from FIG. 1, when the liner 1 is inflated or filled, the top triangular sections 4*x*, 6*x*, 8*x*, 10*x* fold toward each other about their respective top fold lines 66 to form the roof of the cubical liner 1, the bottom triangular sections 4*z*, 6*z*, 8*z*, 10*z* fold toward each other about their respective bottom fold lines 68 to form the floor of the cubical liner 1, and the rectangular sections 4*y*, 6*y*, 8*y*, 10*y* fold about their respective longitudinal side seals 23-26 to form the sidewalls of the cubical liner 1.

As indicated in FIG. 2, the top oblique seals 27, 28, the top cross seal 40, and the side seals 23, 24 generally define front top flaps 4*a*, 4*b* out of the front portion 4. In one embodiment, each front top flap 4*a*, 4*b* will further include corresponding areas of the side portions 8, 10 that are defined by the top oblique seals 27, 28, the top cross seal 40, and the side seals 23, 24.

As shown in FIG. 3, the top oblique seals 29, 30, the top cross seal 40, and the side seals 25, 26 generally define rear top flaps 6*a*, 6*b* out of the rear portion 6. In one embodiment, each rear top flap 6*a*, 6*b* will further include corresponding areas of the side portions 8, 10 that are defined by the top oblique seals 29, 30, the top cross seal 40, and the side seals 25, 26.

As illustrated in FIG. 1, because the front top flaps 4*a*, 4,*b* are sealed to the rear top flaps 6*a*, 6*b* by the top cross seal 40, when the liner 1 is inflated or filled and takes its cubical form, the top flaps 4*a*, 6*a* extend across the top triangular section 8*x* and the top flaps 4*b*, 6*b* extend across the top triangular section 10*x*.

As indicated in FIGS. 2 and 3, in one embodiment, each longitudinal side seal 23-26 has a segment that extends across the respective top oblique seal 27-30 and into the respective top flap 4*a*, 4*b*, 6*a*, 6*b*. In one embodiment, as shown in FIGS. 2 and 3, these top segments 23*a*, 24*a*, 25*a*, 26*a* run from the intersection of the respective oblique seal 27-30 and side seal 23-26 to a point approximately halfway to the top cross seal 40. In other embodiments, the top segments 23*a*, 24*a*, 25*a*, 26*a* will have a greater or lesser length. In one embodiment, each longitudinal side seal 23-26 stops at its intersection with the respective top oblique seal 27-30 such that there are no top segments 23*a*, 24*a*, 25*a*, 26*a*.

As illustrated in FIGS. 2 and 3, in one embodiment, each top flap 4*a*, 4*b*, 6*a*, 6*b* has a tab 2, which has a generally rectangular shape defined by an edge 21, 22 of the respective top flap 4*a*, 4*b*, 6*a*, 6*b* and an L-shaped perforated boarder 70. In other embodiments, the perforated boarder 70 will define tabs 2 with other shapes (e.g., circular, triangular, etc.).

As shown in FIGS. 2 and 3, the short segment of the L-shaped perforated boarder 70 is adjacent and generally parallel to the top cross seal 40. The short segment of the L-shaped perforated boarder 70 forms the free distal end of a tab 2. The long segment of the L-shaped perforated boarder 70 is generally parallel to its respective edge 21, 22 and extends from its intersection with the short segment to a point near its respective top oblique seal 27-30. In one embodiment, each tab 2 has a length that is approximately 2" to approximately 24". In another embodiment, each tab 2 has a length that is approximately 6" to approximately 24". In another embodiment, each tab 2 has a length that is approximately 17" to approximately 21" long. In another embodiment, each tab 2 has a length that is approximately 2" to approximately the distance between the top cross seal 40 and the intersections between the oblique seals 27-30 and the longitudinal side seals 23-26.

In one embodiment, the tabs 2 are of an elongated configuration such that they are sufficiently long to facilitate their attachment and use with a winder as discussed later in this Detailed Description. For example, in one embodiment, the tab 2 is configured such that its length (i.e., the distance from the free distal end of the tab to the intersection between the applicable longitudinal side seal 23-26 and oblique seal 27-30) is approximately two times or greater the width of the tab 2. In another embodiment, the tab 2 is configured such that its length is approximately three times or greater the width of the tab 2. In another embodiment, the tab 2 has a length that is approximately four times or greater the width of the tab 2. In another embodiment, the tab 2 has a length that is approximately five times or greater the width of the tab 2. In another embodiment, the tab 2 has a length that is approximately six times or greater the width of the tab 2.

As indicated in FIGS. 2 and 3, in one embodiment, each tab 2 has a top segment 23*a*, 24*a*, 25*a*, 26*a* that extends along at least a portion of the tab 2 to reinforce the tab 2 by sealing its layers of the respective portion 4-10 together. In another embodiment, no segments 23*a*, 24*a*, 25*a*, 26*a* exist because the longitudinal seal lines 23-26 terminate at their intersections with the oblique seals 27-30.

In other embodiments, the tabs 2 may be shapes other than rectangular and may be defined by perforated lines 70 that have configurations other than an L-shape. For example, a tab 2 may be any shape (e.g., rectangular, triangular, circular, elliptical, etc.) defined in a top flap 4*a*, 4*b*, 6*a*, 6*b* by one or more perforated lines 70 or a combination of one or more perforated lines 70 and a longitudinal side edge 21, 22. Also, the perforated lines 70 corresponding to such shapes may be straight, curved, segmented or otherwise configured to define such shapes.

In one embodiment, a tab 2 may any portion of its respective top flap 4*a*, 4*b*, 6*a*, 6*b*. For example, where a tab 2 comprises essentially all of its respective top flap 4*a*, 4*b*, 6*a*, 6*b*, the perforated lines 70 may run adjacent to the oblique seals 27-30 from the top edge 18 to a point near the intersections between the oblique seals 27-30 and the longitudinal side seals 23-26 such that each tab 2 ends up being all or substantially all of its respective triangular shaped top flap 4*a*, 4*b*, 6*a*, 6*b*. In other words, such a tab 2 would be substantially all of a triangular area defined by a longitudinal side edge 21, 22, a top edge 18 and a perforated line 70 running generally parallel and adjacent to an oblique seal 27-30.

As shown in FIGS. 2 and 3, in one embodiment, an attachment feature 3 exists on each tab 2. In another embodiment, no attachment feature 3 exists on the tabs 2.

In one embodiment the attachment feature 3 is a strip of tape 3 that is affixed to each tab 2. In one embodiment, the tape 3 has two adhesive sides, one adhesive side for adhering to the tab 2 and the other adhesive side for securing the tab 2 to an outer container (i.e., the bag of a FIBC system or the box of a bag-in-box system). In another embodiment, the tape 3 has a single adhesive side for adhering to the tab 2. The tape 3 then acts as reinforcement for the tab 2, thereby allowing the tab 2 to be stitched to the outer container without tearing free.

In one embodiment, the attachment feature 3 is a strip of fabric 3 such as canvas, TYVEX®, or another reinforcing material. The strip of fabric 3 is affixed to the tab 2 via an adhesive or stitching, by being pressed into a tab 2 when the tab 2 is heated to its melting point, or by being sealed between the layers forming a tab 2. The tabs 2 are then affixed to the top portion of the outer container by stitching through the fabric 3 and into the outer container.

In one embodiment, the attachment feature 3 is one or more holes 3. The one or more holes 3 may be any size and any shape, for example circular, elliptical, rectangular, etc. The holes may be reinforced with a grommet or by sealing together the layers comprising the tab 2 at or near the boarder of the hole 3. Alternatively, the holes 3 may be formed without reinforcement. The tabs 2 are affixed to the top portion of the outer container by stitching through the one or more holes 3 and into the outer container. Alternatively, the one or more holes 3 may be tied to the outer container or attached to a hook extending from the outer container.

As can be understood from FIGS. 1-3, the configuration of the tabs 2 is advantageous because the tabs 2 are outside the contents containment area of the liner 1. Thus, if a tab 1 breaks, a seal 23-30 is not ruptured and the liner 1 does not end up leaking. Furthermore, as can be understood from FIGS. 1-3 and the preceding discussion, in one embodiment, each tab 2 employs all of the layers of any two adjacent portions 6-10. Thus, the tabs 2 have twice the strength of any single portion 6-10. Additionally, unlike some prior art liners that have tabs formed exclusively of tape adhered to the walls of said liners, the tabs 2 of the present liner 1 can rely on the tensile strength of the polymer sheets forming the portions 8-10 of the liner 1. This results in a stronger configuration for the tabs 2.

Figure 5B:
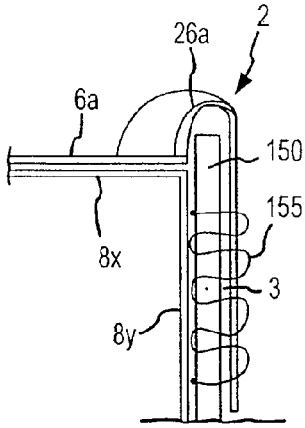
FIG. 5*b* is a vertical sectional view taken along section line 5*b*-5*b* of FIG. 5*a* of a tab affixed to the surface of an outer container.
Figure 5A:
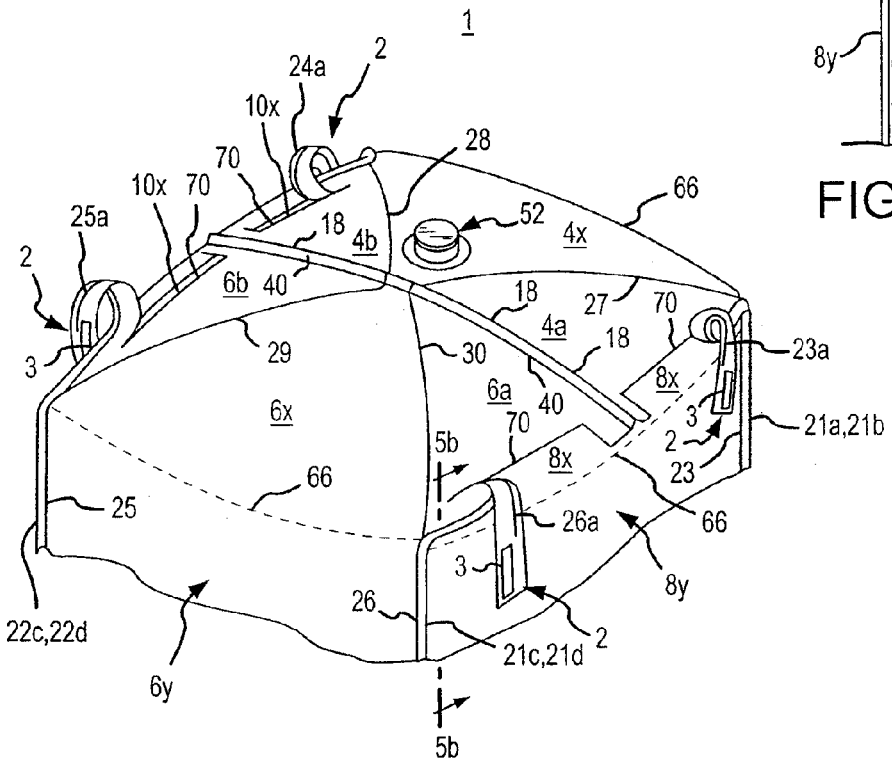
FIG. 5*a* is a top isometric view of the upper portion of the liner in its inflated or filled state with the tabs detached in preparation for engagement with an outer container.

For a better understanding of the deployment of the tabs 2, reference is now made to FIGS. 5*a* and 5*b*. FIG. 5*a* is a top isometric view of the upper portion of the liner 1 in its inflated or filled state with the tabs 2 detached in preparation for engagement with an outer container. FIG. 5*b* is a vertical sectional view taken along section line 5*b*-5*b* of FIG. 5*a* of a tab 2 affixed to the surface of an outer container 150.

As shown in FIG. 5*a*, each tab 2 has been separated from its respective top flap 4*a*, 4*b*, 6*a*, 6*b* along its L-shaped perforated boarder 70. This separation of a tab 2 may be achieved by simply pulling on the tab 2 until its perforated L-shaped boarder 70 gives way. As indicated in FIG. 5*b*, the tabs 2 when separated have sufficient length to allow them to be affixed to an outside container 150 via an adhesive and/or stitching 155. Alternatively, the tabs 2 may be of a sufficient length to allow them to be affixed to an outside container via hooks or tie ropes.

For a continued discussion of the general configuration of one embodiment of the liner 1, reference is again made to FIGS. 1-3. As indicated in FIG. 2, the bottom oblique seals 31, 32, the bottom cross seal 42, and the side seals 23, 24 generally define front bottom flaps 4*c*, 4*d* out of the front portion 4. In one embodiment, each front bottom flap 4*c*, 4*d* will further include corresponding areas of the side portions 8, 10 that are defined by the bottom oblique seals 31, 32, the bottom cross seal 42, and the side seals 23, 24.

As shown in FIG. 3, the bottom oblique seals 33, 34, the bottom cross seal 42, and the side seals 25, 26 generally define rear bottom flaps 6*c*, 6*d* out of the rear portion 6. In one embodiment, each rear bottom flap 6*c*, 6*d* will further include corresponding areas of the side portions 8, 10 that are defined by the bottom oblique seals 33, 34, the bottom cross seal 42, and the side seals 25, 26.

As can be understood from FIG. 1, because the front bottom flaps 4*c*, 4*d* are sealed to the rear bottom flaps 6*c*, 6*d* by the bottom cross seal 42, when the liner 1 is inflated or filled and takes its cubical form, the bottom flaps 4*c*, 6*c* extend across the bottom triangular section 8*z* and the bottom flaps 4*d*, 6*d* extend across the bottom triangular section 10*z*.

As indicated in FIGS. 2 and 3, each longitudinal side seal 23-26 has a segment that extends across the respective bottom oblique seal 31-34 into the respective bottom flap 4*c*, 4*d*, 6*c*, 6*d*. In one embodiment, as shown in FIGS. 2 and 3, these bottom segments 23*b*, 24*b*, 25*b*, 26*b* run from the intersection of the respective oblique seal 31-34 and side seal 23-26 to a point nearly intersecting the bottom cross seal 42. In other embodiments, the bottom segments 23*b*, 24*b*, 25*b*, 26*b* will have a greater or lesser length. In one embodiment, each longitudinal side seal 23-26 stops at its intersection with the respective bottom oblique seal 31-34 such that there are no bottom segments 23*b*, 24*b*, 25*b*, 26*b*.

As indicated in FIGS. 2 and 3, in one embodiment, the bottom flaps 4*c*, 4*d*, 6*c*, 6*d* are not provided with tabs 2. In other embodiments, the bottom flaps 4*c*, 4*d*, 6*c*, 6*d* are provided with tabs 2, which can be configured similarly to those found on the top flaps 4*a*, 4*b*, 6*a*, 6*b*.

For a discussion of the location of the fill and drain orifices of the liner 1, reference is now made to FIG. 2. As shown in FIG. 2, the front portion 4 is formed with two openings. Mounted in those openings are two tubular fitments, a drain fitment 50 and fill fitment 52. The drain fitment 50 is intended to function as a drain and may be located generally equidistant from the two longitudinal side edges 21, 22 of the front portion 4 at a point that is almost even with the intersections between the bottom oblique seals 31, 32 and the longitudinal side seals 23, 24. The fill fitment 52 is for filling purposes and is typically located close to the intersections of the top cross seal 40 with the top oblique seals 27, 28. In one embodiment, the liner 1 will only have a drain fitment 50. In another embodiment, the liner 1 will only have a fill fitment 52.

For a discussion of one method of securing the fitments 50, 52 to the front portion 4, reference is now made to FIG. 6, which is a cross sectional view of one type of fill fitment 52 taken along line 6-6 of FIG. 2. As indicated in FIG. 6, the fill fitment 52 comprises two parts, a fixed tubular part 56 and a cap 62. The fixed tubular part 56 has a flange 58 that underlies and is sealed to the front portion 4 by a circular seal 60. The cap 62 is releasably attached to and closes off the tubular part 56. The cap 60 may be attached to the tubular part 56 by a screw, bayonet, snap-fit or other suitable form of connection known in the art.

For a better understanding of how the four portions 4-10 join together and how the liner 1 appears when inflated or filled, reference is again made to FIG. 1. As illustrated in FIG. 1, the liner 1 assumes the general shape of a cube or a rectangular parallelepiped when is inflated or filled, with the side portions 8, 10 unfolding to eliminate the gussets. The front portion 4 forms a front wall, the rear portion 6 forms a rear wall, and the side portions 8, 10 form opposite sidewalls.

As shown in FIG. 1, because of the arrangement of the oblique seals 27-34 in relation to the longitudinal seals 23-26 and cross seals 40, 42, the four portions 4-10 come together to form the top and bottom walls of the liner 1. As illustrated in FIG. 1, the filler fitment 52 is located at the top of the liner 1 and the drain fitment 50 is located at the bottom, front side of the liner 1.

As can be understood from FIG. 1, when inflated or filled, the liner 1 is self-supporting in the sense that it tends to remain erect and not fall over when its bottom end is resting on a flat floor or platform. When an un-inflated liner 1 is inserted in an outside container, the flexibility of the un-inflated liner 1 allows the drain fitment 50 to be properly positioned in any commodity discharge opening provided in the bottom of the outside container. Once so positioned, the cap 62 of the drain fitment 50 may be removed to initiate the liner-emptying process for an inflated or filled liner 1.

As previously explained, the flexibility of the material comprising the four portions 4-10 may cause a liner 1 to tend to collapse at its upper portion when the liner 1 is being emptied of its contents via the drain 50. Such a collapsing of the liner 1 makes it difficult to completely empty the liner 1 of viscous contents such as peanut butter, industrial oil or the like. Thus, it is desirable to support the upper portion of the liner 1 off of an upper portion of the outside container. The tabs 2 of the present invention provide an inexpensive means of supporting the liner 1 off of the outside container.

As indicated hereinabove, the four portions 4-10 that make up the liner may consist of a single ply or two or more plies. In the case of two or more plies, it is to be understood that the plies are separate from one another except in the areas of the seals described above, and that each ply may consist of a single plastic film or be a laminate of two or more materials.

Figure 8:
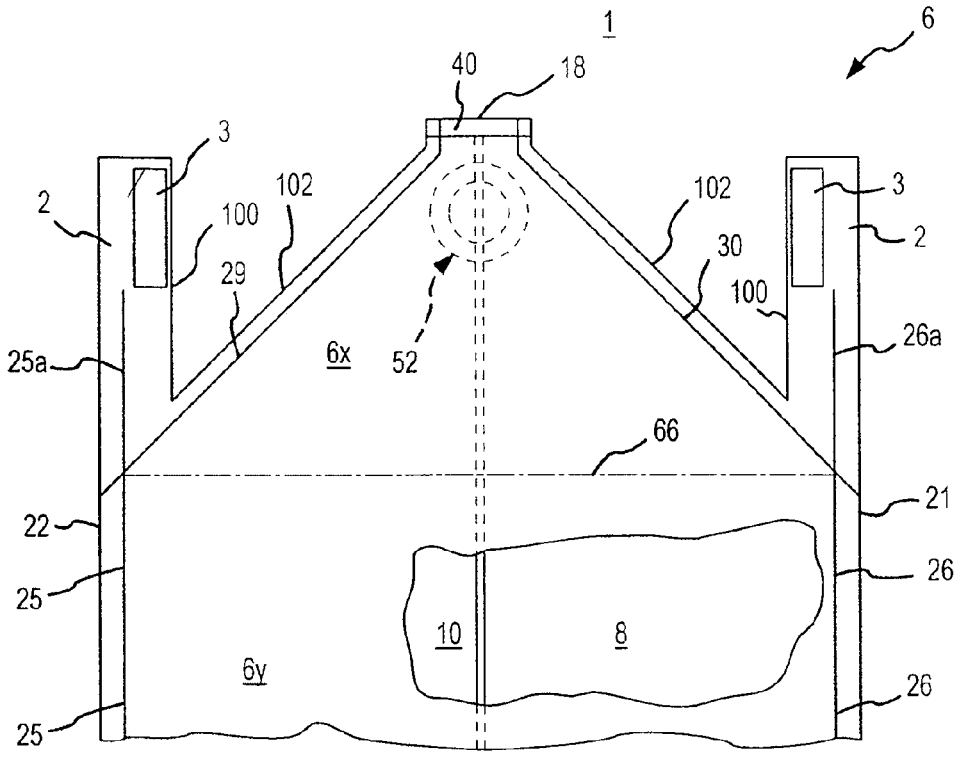
FIG. 8 is a bottom view of the upper portion of the liner depicted in FIG. 7 in its flattened as-made condition, with a part of the liner broken away.
Figure 7:
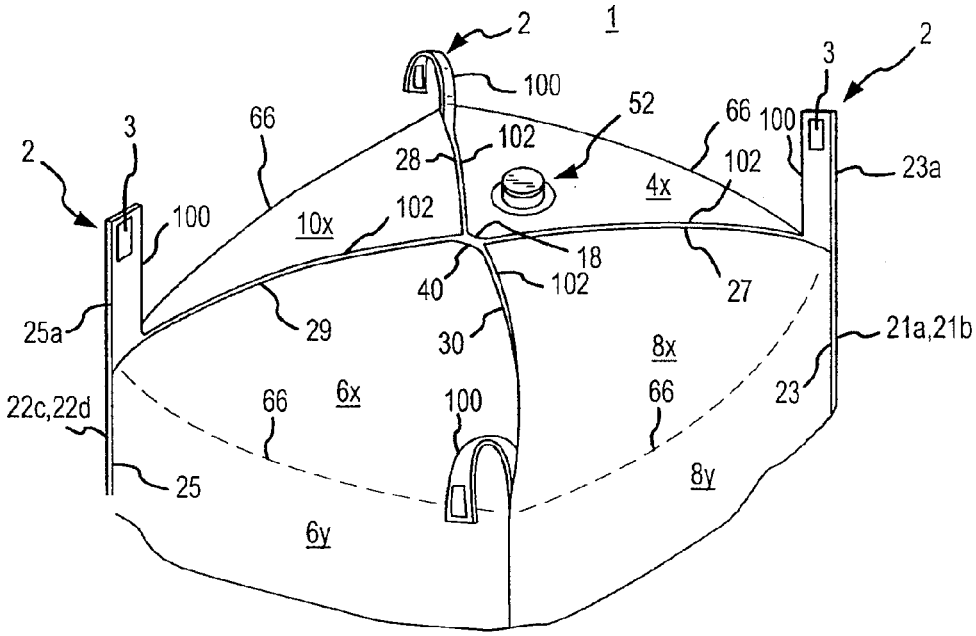
FIG. 7 is a top isometric view of the upper portion of the liner in its inflated or filled state with an alternative embodiment of the tabs.

For a discussion of another embodiment of the liner 1, reference is now made to FIGS. 7 and 8. FIG. 7 is a top isometric view of the upper portion of the liner 1 in its inflated or filled state with an alternative embodiment of the tabs 2. FIG. 8 is a bottom view of the upper portion of the liner 1 depicted in FIG. 7 in its flattened as-made condition, with part of the liner broken away to reveal the side portions 8, 10 above.

As shown in FIGS. 7 and 8, the top flaps 4*a*, 4*b*, 6*a*, 6*b* (depicted in FIGS. 1-3) have been trimmed away along tab edges 100 and oblique edges 102 to form another embodiment of the tabs 2. The tabs 2 depicted in FIGS. 7 and 8 have attachment features 3 (as previously discussed in this Detailed Description) for affixing the tabs 2 to an outside container. In one embodiment, each tab 2 also has and a top segment 23*a*, 24*a*, 25*a*, 26*a* that extends along at least a portion of the tab 2 to reinforce the tab 2 by sealing together its layers of the respective portions 4-10. In another embodiment, the tabs 2 are not provided with top segment 23*a*, 24*a*, 25*a*, 26*a*. The four portions 4-10 may consist of a single ply or two or more plies as described above.

In one embodiment, the tabs 2 may have lengths as previously discussed in this Detailed Description. In other embodiments, the tabs 2 may have lengths such that they extend out approximately as far as the top edge 18 of the liner 1.

Figure 10:
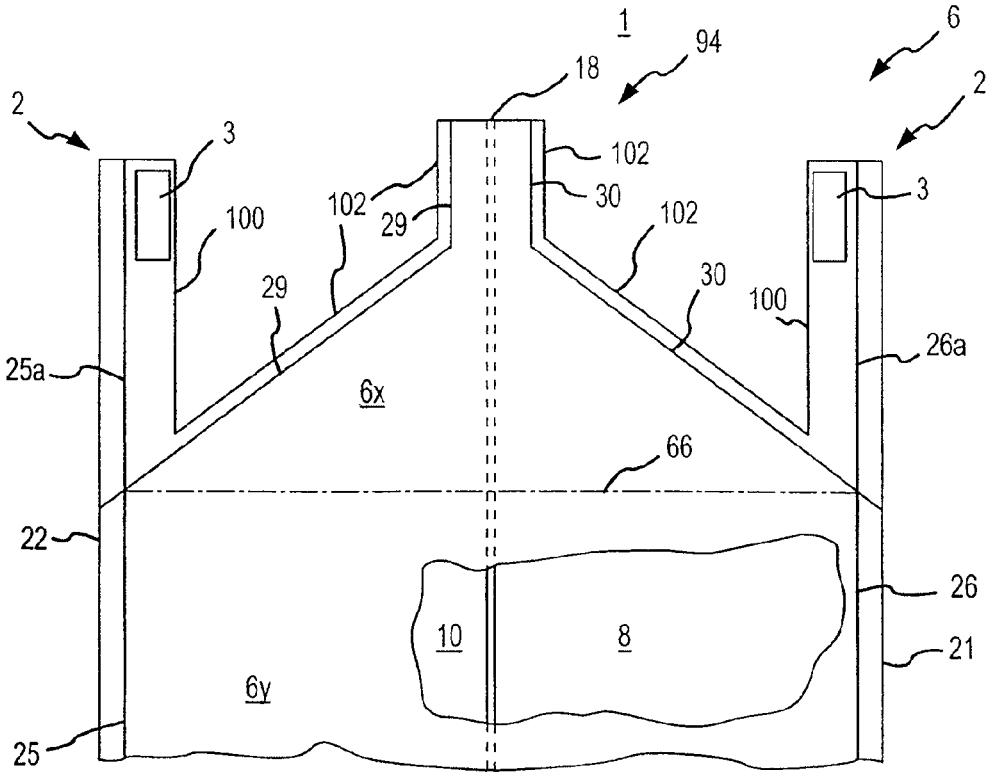
FIG. 10 is a bottom view of the upper portion of the liner depicted in FIG. 9 in its flattened as-made condition, with a part of the liner broken away. In the several figures like numerals designate like elements.
Figure 9:
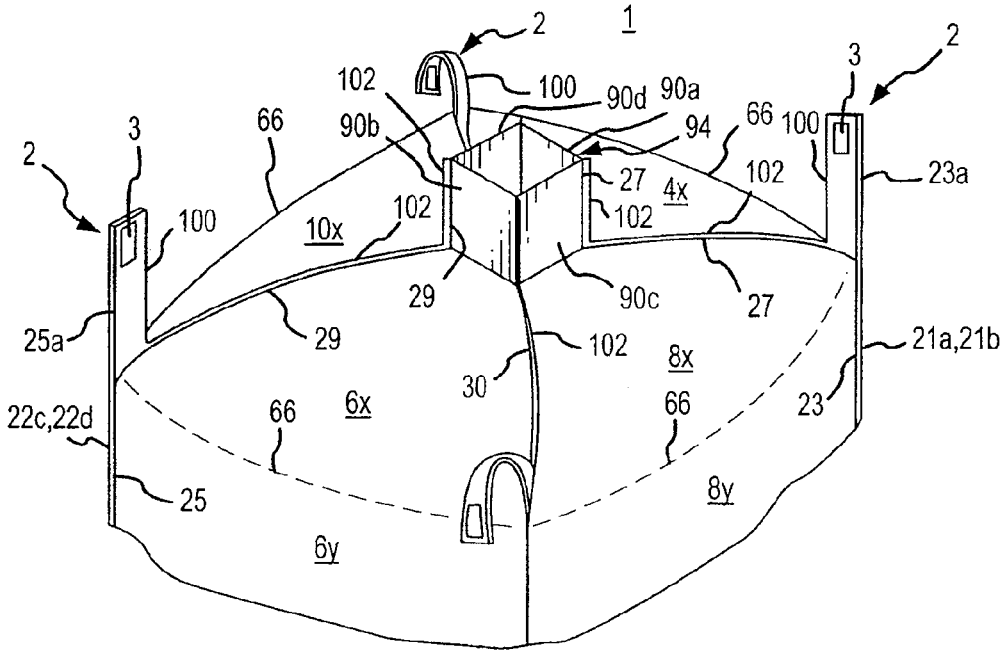
FIG. 9 is a top isometric view of the upper portion of the liner in its inflated or filled state with an open neck top and an alternative embodiment of the tabs.

For a discussion of yet another embodiment of the liner 1, reference is now made to FIGS. 9 and 10. FIG. 9 is a top isometric view of the upper portion of the liner 1 in its inflated or filled state with an open neck top and an alternative embodiment of the tabs 2. FIG. 10 is a bottom view of the upper portion of the liner 1 depicted in FIG. 9 in its flattened as-made condition, with part of the liner broken away to reveal the side portions 8, 10 above.

As indicated in FIGS. 9 and 10, in one embodiment, the filler fitment 52 is omitted from the front portion 4 (the hole for the filler fitment 52 is also omitted) and the top oblique seals 27-30 are modified by extending them so as to form neck sections 90*a*, 90*b*, 90*c*, 90*d*. While the top oblique seals 27-30 are extended to the top end edge 18 of the neck sections 90*a*, 90*b*, 90*c*, 90*d*, the neck sections are not sealed together with a cross-seal 40 (depicted in FIGS. 1-3).

As shown in FIG. 9, when the liner is inflated the neck sections 90*a*, 90*b*, 90*c*, 90*d* of the four portions 4-10 form a spout 94 with a substantially square cross-sectional configuration that can be used for filling the liner 1 with a selected liquid or particulate commodity. After the liner 1 has been filled, the spout 94 can be sealed shut by securing together the four sections 90*a*, 90*b*, 90*c*, 90*d* (e.g., by an adhesive, stitching, stapling, heat sealing, or adding a closure member (not shown) that fits over or inside the spout and seals it to the spout). The four portions 4-10 may consist of a single ply or two or more plies as described above.

The alternative embodiment shown in FIGS. 9 and 10 may be preferred for certain applications where it is customary to employ liners with spouts (e.g. the applications contemplated for outer containers and liners disclosed in U.S. Pat. No. 6,371,646, issued Apr. 16, 2002 to L. LaFleur, and U.S. Pat. No. 4,596,040, issued Jun. 17, 1986 to A. E. Lafleur et al, both of which are hereby incorporated in their entireties into this Detailed Description).

In one embodiment, the tabs 2 may have lengths as previously discussed in this Detailed Description. In other embodiments, the tabs 2 may have lengths such that they extend out approximately as far as the top edge 18 of the liner 1.

Of course the invention is susceptible of other modifications and may be applied to liners 1 of different constructions. For example, instead of being L-shaped, the perforated lines 70 may be formed as a single line curved in an arc. Alternatively, the perforated lines 70 may run adjacent to the oblique seals 27-30 from a point near the intersections between the oblique seals 27-30 and the longitudinal side seals 23-26 to the top edge 18 such that each tab 2 ends up being all or substantially all of its respective top flap 4*a*, 4*b*, 6*a*, 6*b*.

In one embodiment, the fitments 50, 52 may have different structures or shapes. In one embodiment, the filler fitment 52 may be omitted, in which case the drain fitment 50 may also serve as a filler means for the liner by attaching a pump discharge line to pump the contents into the liner 1. Conversely, the drain fitment 50 may be omitted, in which case the filler fitment 52 may also serve as a drain means for the liner by running a pump suction line down into the liner to remove the contents of the liner 1.

Although the preferred construction is a liner that has a substantially cubic shape when inflated (in which case the side portions 8, 10 have substantially the same width when unfolded as the front and rear portions 4, 6), the liner also may be formed so as to have a rectangular parallelepiped shape when inflated (e.g., the side portions 8, 10 may have smaller widths than the front and rear portions 4, 6.

Although the seals whereby the four portions 4-10 are connected together are illustrated by single lines, it is to be understood that the cross-seals and the longitudinal and oblique seals that connect the front and rear portions 4, 6 to the side portions 8, 10 may vary in width and, for example, may extend out to the edges of the four portions 4-10.

Figure 11:
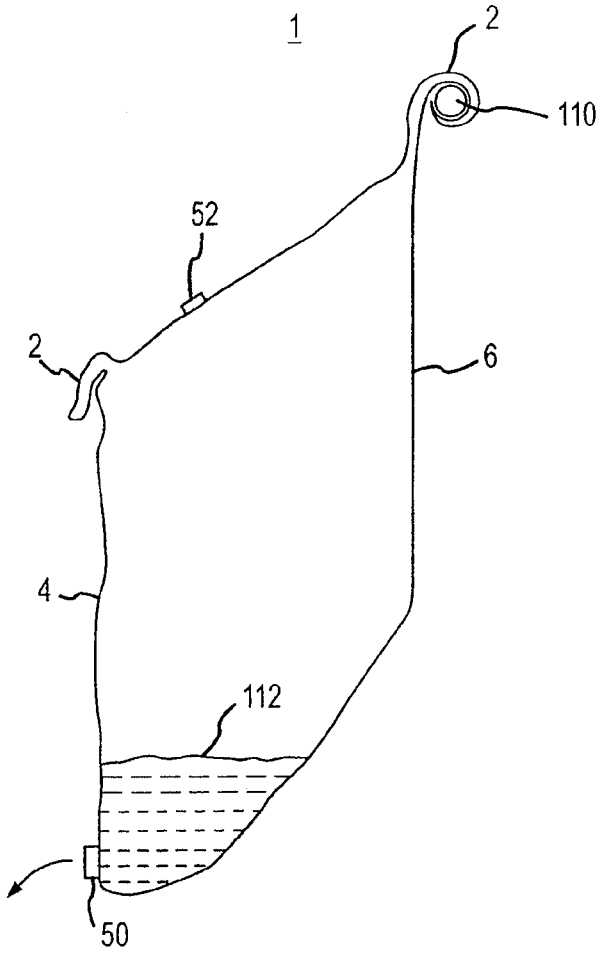
FIG. 11 is a side elevation of a liner attached to a winder system to facilitate the complete emptying of the liner.

For a discussion of the employment of a winder system with the tabs 2 of the liner 1, reference is now made to FIG. 11. FIG. 11 is a side elevation of a liner 1 attached to a winder system 110 to facilitate the complete removal of the contents 112 of the liner 1 during the emptying of the liner 1. As indicated in FIG. 1, the tabs 2 extending from the rear portion 6 are attached to the winder 110. As the tabs 2 are wound about the winder 110, the bottom rear edge of the liner 1 is elevated. This causes the contents 112 of the liner 1 to flow towards the drain fitment 50, which facilitates complete removal of the contents 112 from the liner 1. Because of the length and configuration of the tabs 2, as previously discussed in this Detailed Description, the tabs 2 are ideal for use with a winder 110. This is because the tabs 2 have a high tensile strength due to having twice the layers of any sidewall of the liner. Also, should a tab 2 fail, a seam of the liner is less likely to tear and leak.

Although the present invention has been described with reference to preferred embodiments, persons skilled in the art will recognize that changes may be made in form and detail without departing from the spirit and scope of the invention.

We claim:

1. A liner for use in a bulk container and for containing a substance, the liner comprising:

a first flexible panel having a first end;

a second flexible panel adjacent to the first flexible panel and having a second end arranged parallel to the first end;

a first seal joining the first end to the second end;

a second seal joining the first panel to the second panel and being arranged obliquely to the first seal and forming an intersection therewith, the second seal having an arcuate portion near the intersection and intersecting the first seal substantially perpendicularly; and a fitment arranged on the first panel for one of filling the liner, draining the liner, and both filling and draining the liner.

2. The liner of claim 1, wherein the first flexible panel includes a first longitudinal side generally perpendicular to the first end and the second flexible panel includes a second longitudinal side generally perpendicular to the second end, the first and second sides being arranged adjacent and parallel to one another.

3. The liner of claim 2, wherein the second seal intersects the first and second longitudinal sides at an angle.

4. The liner of claim 1, wherein the arcuate portion is a curve having a radius.

5. The liner of claim 4, wherein the radius is between approximately 0.5" and 4.0".

6. The liner of claim 5, wherein the radius is approximately 2.0".

7. The liner of claim 1, wherein the second seal separates the first panel into a front portion and a front flap, the front portion having a hexagonal shape that is truncated at the first end.

8. The liner of claim 1, wherein the second panel is a first portion of a larger panel with a fold forming a gusset, the larger panel having a second portion separated from the first portion by the fold.

9. The liner of claim 8, wherein the second portion of the larger panel has a third end aligned with the second end, the first seal joining the first, second and third ends and the second seal limited to joining only the first panel and the second panel.

10. A liner for use in a bulk container, the liner comprising:

a first flexible panel with side edges and a second flexible panel opposed to the first panel;

a third flexible panel and a fourth flexible panel opposed to the third flexible panel, said third and fourth flexible panels located between the first and second panels;

a top seal joining the first, second, third, and fourth panels along top edges of the first, second, third, and fourth panels;

a bottom seal joining the first, second, third, and fourth panels along bottom edges of the first, second, third, and fourth panels; and a first pair of oblique seals joining the first panel to the third and fourth panels, said first pair of oblique seals running generally oblique to the side edges of the first panel and converging toward each other and toward the top seal to define a first truncated apex, each oblique seal of said first pair of oblique seals having a portion near the first apex that transitions through a radius to a segment generally parallel to the side edges of the first panel and intersects the top seal generally perpendicularly;

wherein the segment generally parallel to the side edges begins some distance before intersecting the top seal; and wherein the first pair of oblique seals continue, free from any perforation or cut lines, from approximately the side edges of the first panel to the top seal.

* * * * *